US005233809A

United States Patent [19]

Gropper

[11] Patent Number: 5,233,809

[45] Date of Patent: Aug. 10, 1993

[54] PORTABLE ANTENNA MAST SUPPORT SYSTEM

[76] Inventor: Daniel R. Gropper, 9908 Dale Ridge Ct., Vienna, Va. 22181

[21] Appl. No.: 770,341

[22] Filed: Oct. 3, 1991

[51] Int. Cl.[5] ..... E04H 12/20

[52] U.S. Cl. ..... 52/150; 52/116; 52/110; 343/882

[58] Field of Search ..... 52/110, 116, 121, 111, 52/648, 649, 651, 651.07, 148-152; 343/878, 880, 881, 882; 248/519, 529, 528; 285/156

[56] References Cited

U.S. PATENT DOCUMENTS

| | | | |
|---|---|---|---|
| 2,581,351 | 1/1952 | Black | 52/116 X |
| 2,621,878 | 12/1952 | Kruger | 248/528 X |
| 3,605,359 | 9/1971 | Bader et al. | 52/116 X |
| 3,714,660 | 1/1973 | Scrafford et al. | 343/882 X |
| 3,875,573 | 4/1975 | Bueckert | 343/882 X |
| 3,955,787 | 5/1976 | Brown | 248/528 X |
| 4,104,642 | 8/1978 | Padilla et al. | 343/882 |
| 4,146,897 | 3/1979 | Wilson et al. | 343/882 |
| 4,404,565 | 9/1983 | Gurney et al. | 343/882 X |
| 4,545,604 | 10/1985 | Braathen | 285/156 |
| 4,723,128 | 2/1988 | Gasque, Jr. | 343/880 |
| 4,893,841 | 1/1990 | Bowen | 285/156 |

FOREIGN PATENT DOCUMENTS

| | | | |
|---|---|---|---|
| 1602194 | 11/1981 | United Kingdom | 343/882 |

*Primary Examiner*—Carl D. Friedman
*Assistant Examiner*—Kien Nguyen
*Attorney, Agent, or Firm*—Daniel R. Gropper

[57] ABSTRACT

This invention relates to a portable, easy-to-put-together, strong, durable mast support system for use in field operations where an antenna mast, or other similar mast, needs to be safely and quickly assembled, raised and supported. The mast support system is comprised of few pieces which stack in a compact longitudinal bundle for easy transportation to or from a site of use or for storage. When packed for shipment, the entire assembly may easily be placed on the top of a car or other vehicle. The mast support system is assembled through use of slideably interlocking pieces with hitch pins or clips. No special tools are required. The mast support system features a rotatable mast base alignment and support receptacle to enable one person to safely raise and lower a long mast after an antenna or other device has been safely affixed to the top of the mast when the mast is still at a safe horizontal ground-level position.

The primary anticipated use for the mast support system is when free-standing quick setup masts are required, is either an emergency or permanent installation. The system may be used in back yards, driveways, fields, parking lots, and on platforms or rooftops, or in other suitable areas.

20 Claims, 6 Drawing Sheets

PORTABLE ANTENNA MAST SUPPORT SYSTEM

BRIEF SUMMARY OF THE INVENTION

This invention relates to a light-weight, durable, inexpensive and easy to assemble antenna mast support system featuring a rotatable mast base receptacle. This system will enable one person to safely raise and lower a long mast with an antenna, or other device, affixed to the top of the mast. The antenna mast support system has three basic elements: a center pyramid which will support the mast; a ground contacting base having fittings to slideably interlock with the pyramid legs; and, a base diagonal cross member for alignment of the mast base receptacle with respect to the ground contacting base.

FIELD AND BACKGROUND OF THE INVENTION

An object of this invention is to provide a portable, easy-to-put-together, strong, durable mast support system for use in field operations where an antenna mast, or other similar mast, needs to be safely and quickly assembled, raised and supported.

Another object of this invention is to provide a mast support system composed of few pieces which stack in a compact longitudinally aligned bundle for easy transportation to or from a site of use or for storage.

Another object of this invention is to provide a mast support system which may be easily placed on the top of a car or other vehicle for transport to and from a remote site.

Another object of this invention is to provide a mast support system which is assembled through use of slideably interlocking pieces with hitch pins and spring clips where no special tools are required for assembly or disassembly.

Another object of this invention is to provide a mast support system featuring a rotatable mast base receptacle to enable one person to safely raise and lower a long mast after an antenna, or other device, has been affixed to the top of the mast when the mast is still in a safe horizontal position.

Another object of this invention is to provide a mast support system which is free standing and is easily set up for emergency and/or permanent installation.

Another object of this invention is to provide a mast support system for use in backyards, driveways, fields, parking lots and on platforms or rooftops or other suitable areas.

SUMMARY OF THE INVENTION

The problem of how to safely raise, support and bring down masts has long been a problem of both civilians and the military, particularly when operating under adverse weather conditions.

The invention disclosed herein teaches a simple, durable and safe mast supporting system. The system is easily transportable, and can be easily assembled and disassembled without tools. The system maintains safe control over the mast during raising, supporting and lowering operations. The system permits antennas and/or other apparatus to be placed on the mast when the mast is in the horizontal position and, if necessary, permits one person to raise and lower the mast. The system has successfully withstood high winds, lightning and torrential rain without stress or failure.

DESCRIPTION OF THE PREFERRED EMBODIMENTS

This invention relates to an inexpensive, portable, mast-supporting system that can be easily transported and set up in the field under adverse conditions, in temporary or permanent installations and on uneven ground.

Figure 1:
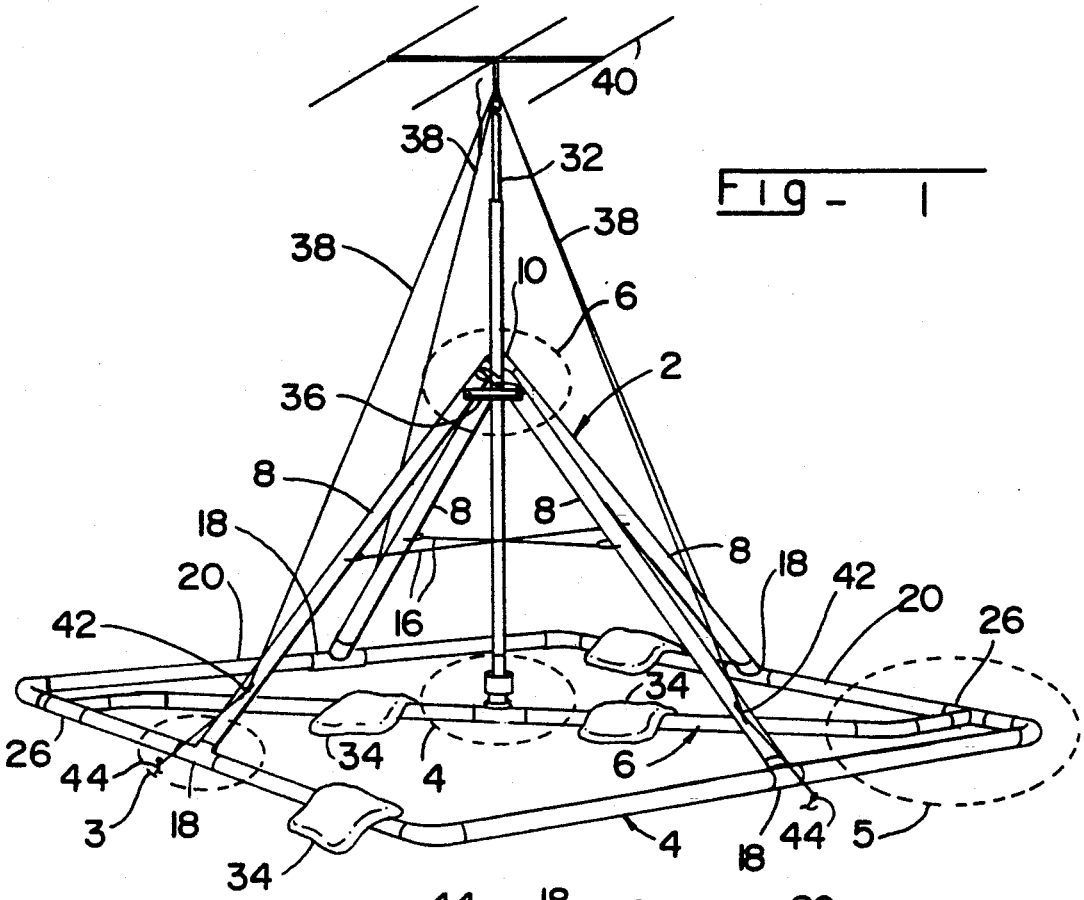
FIG. 1 is a perspective view of the mast supporting system in the raised position showing an antenna, guy ropes, the center pyramid and the base including the base diagonal and the rotatable mast base receptacle.
Figure 2:
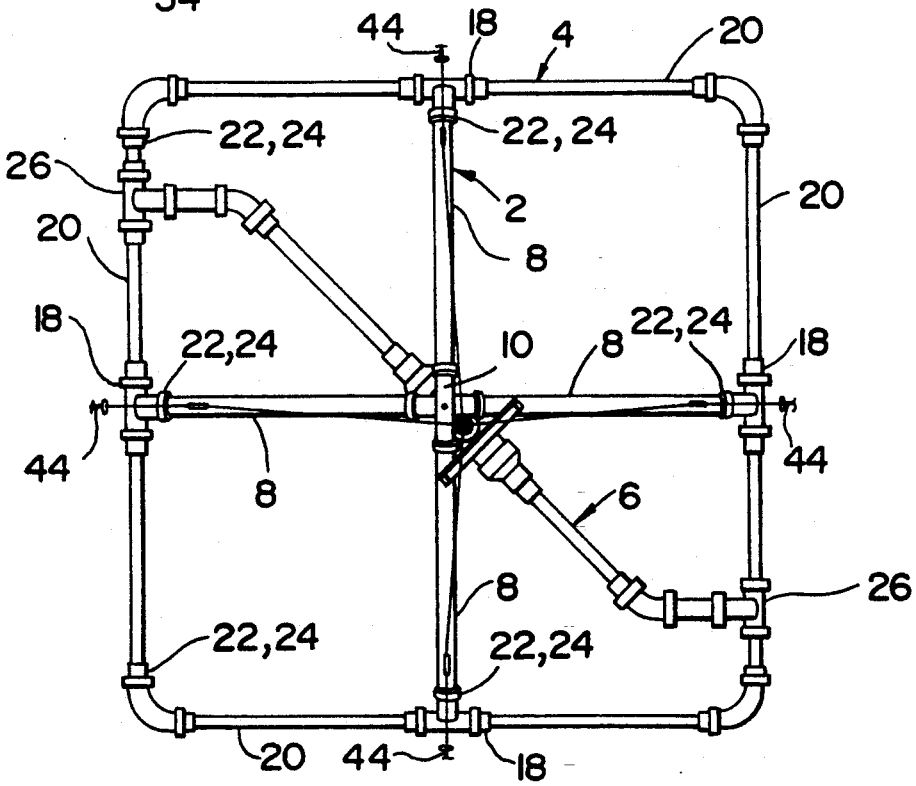
FIG. 2 is a top view of the invention.

Referring to FIG. 1, the mast support system is comprised of a pyramid, generally 2, a base, generally 4, and a center diagonal, generally 6.

All pyramid 2, base 4, and center-diagonal 6 components should be constructed of weather-resistant and resilient material, such as, but not limited to polyvinyl chloride PVC, aluminum, galvanized steel, or certain alloys that meet these structural and weather-resistant requirements.

Figure 9:
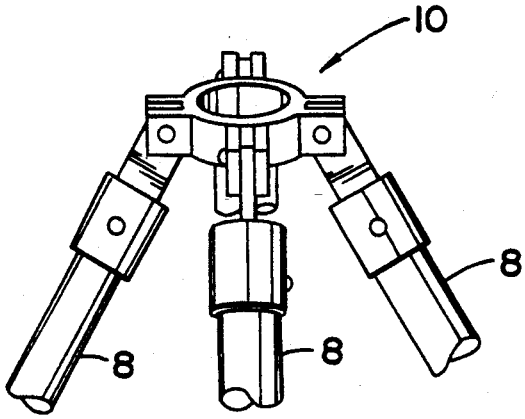
FIG. 9 is a perspective view of an alternate pyramid assembly with hinged legs.
Figure 10:
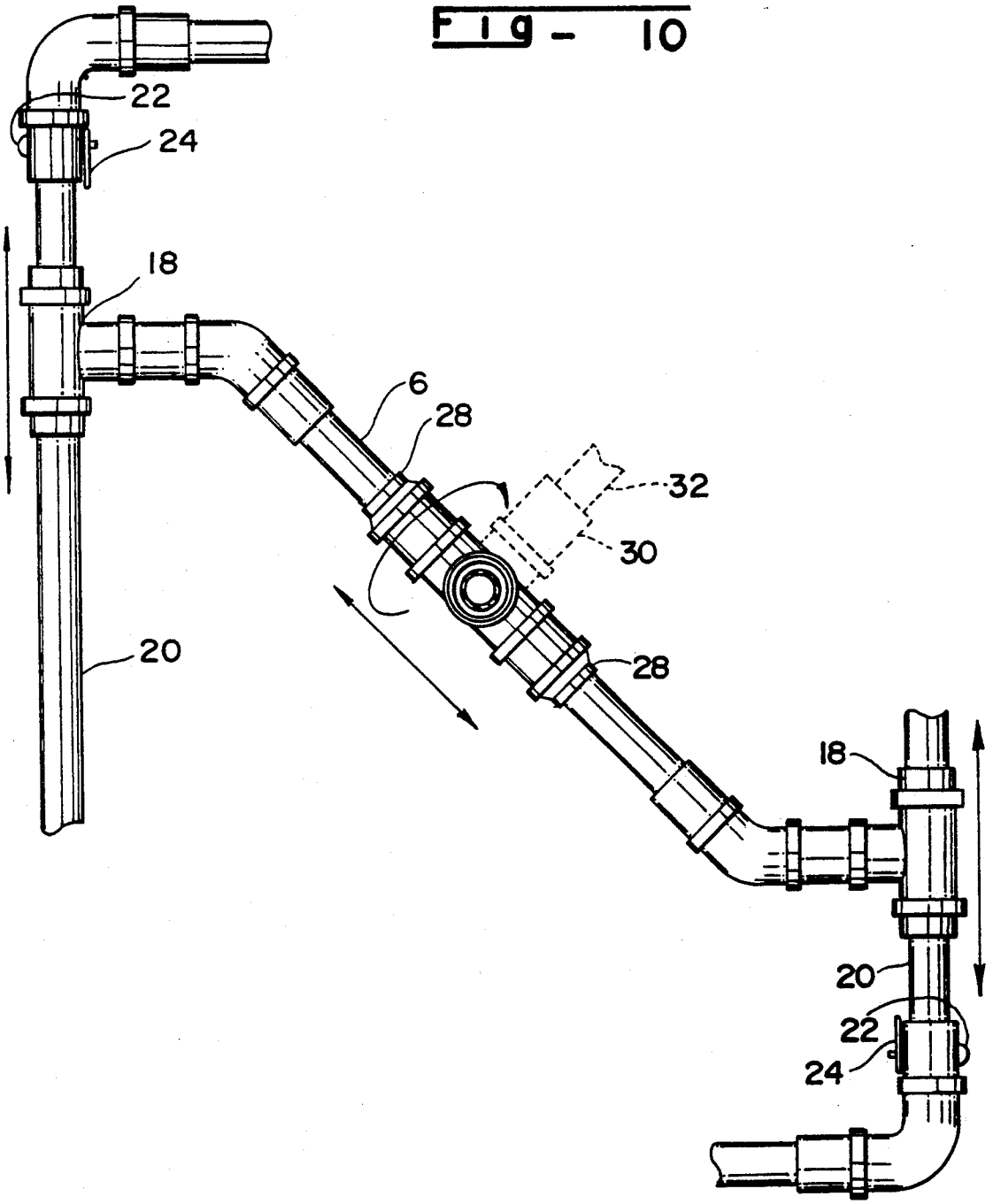
FIG. 10 is a top plane view of the center diagonal connection to the base legs.

The pyramid 2 is comprised of three or four legs 8, the top of each leg being rigidly connected, FIG. 1, or hingedly connected, FIG. 9, to a center cap 10. It will be understood that numerous commonly-known mechanical connections between each leg 8 and the center cap 10 are possible and anticipated. The hinged configuration, FIG. 9, permits each leg 8 to pivot from a closed position for transportation and storage, where each leg 8 lies adjacent to one another, to an open position for operation, where each leg 8 is spread to slideably mate with a base T-fitting 18, FIGS. 3A and 3B on each base leg 20.

Figure 6:
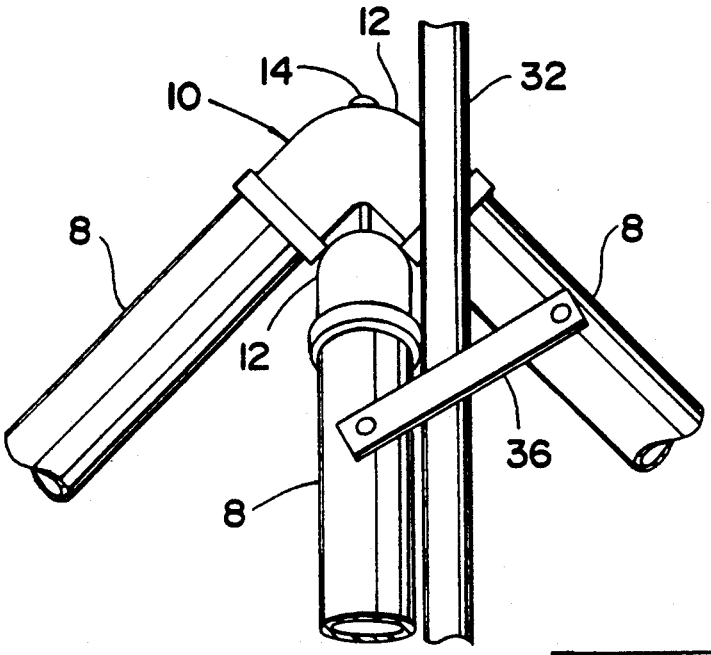
FIG. 6 is a perspective view of a mast supported and held in vertical alignment between two pyramid legs by a restraining bar.
Figure 7:
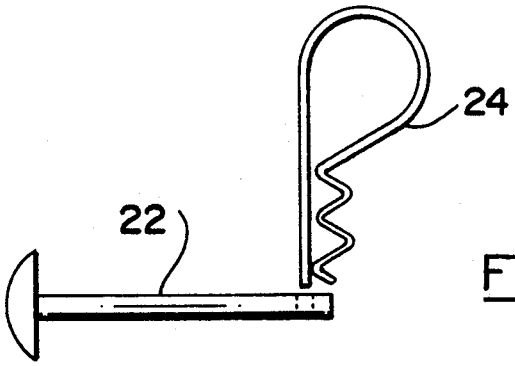
FIG. 7 is a front view of a hitch pin with a spring clip used to lock adjoining sections together.

Referring to FIG. 6, the pyramid 2 may be formed by creating two triangular sets of pyramid legs 8 by placing a leg 8 in each end of an elbow 12 and placing a bolt 14 vertically through two elbows 12. The through-bolt 14 may be removed to permit the triangular sets of pyramid legs 8 to be stacked in a planar orientation for transportation and storage. Alternately, the triangular sets of pyramid legs can be set to hingedly rotate from an open to a planar position about a central axle.

For additional structural integrity of the pyramid legs 8, a cross-pyramid leg support 16 preferably made of a strong resilient material such as ⅛ inch aircraft steel cable, may be stretched between opposite pyramid legs 8. Each cross-pyramid leg support 16 is attached to each pyramid leg by any conventional means, such as with a conventional screw-eye through-bolted through each pyramid leg 8.

Figure 3A:
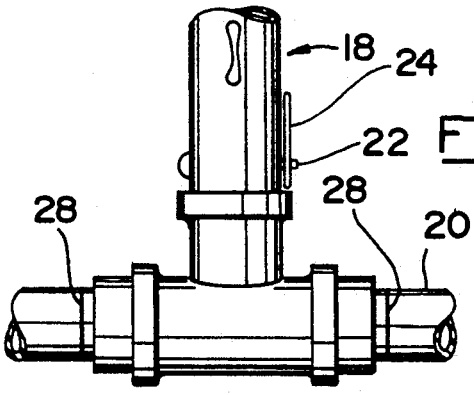
FIG. 3A is a front view of one of the four "T's" each of which is slideably connected with a leg of the pyramid.
Figure 3B:
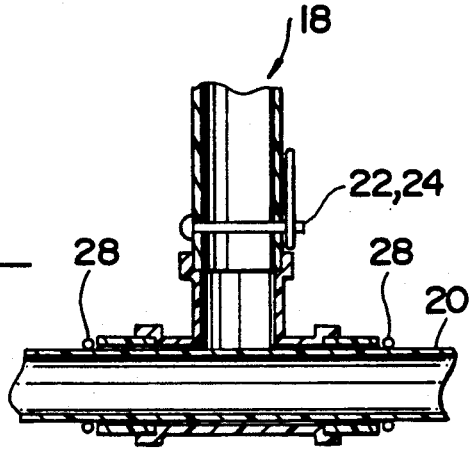
FIG. 3B is a cut away view of one of the four "T's" each of which is slideably connected with a leg of the pyramid.
Figure 4A:
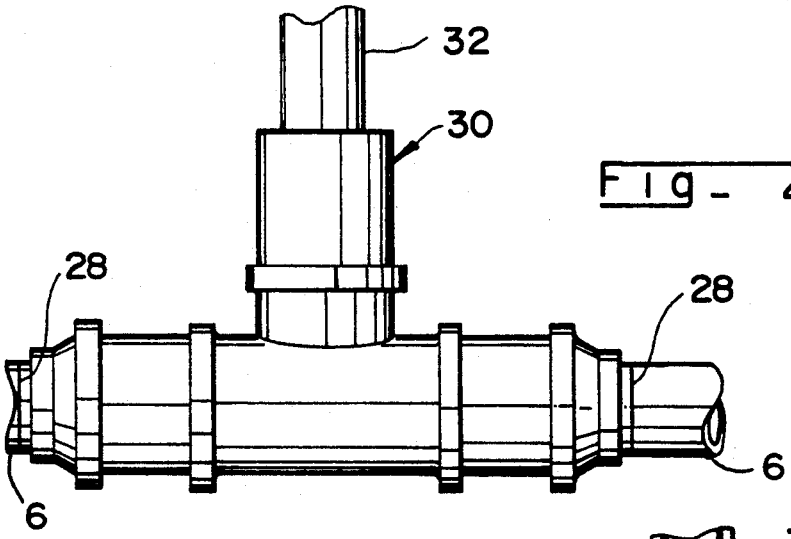
FIG. 4A is a front view of the mast base receptacle.
Figure 4B:
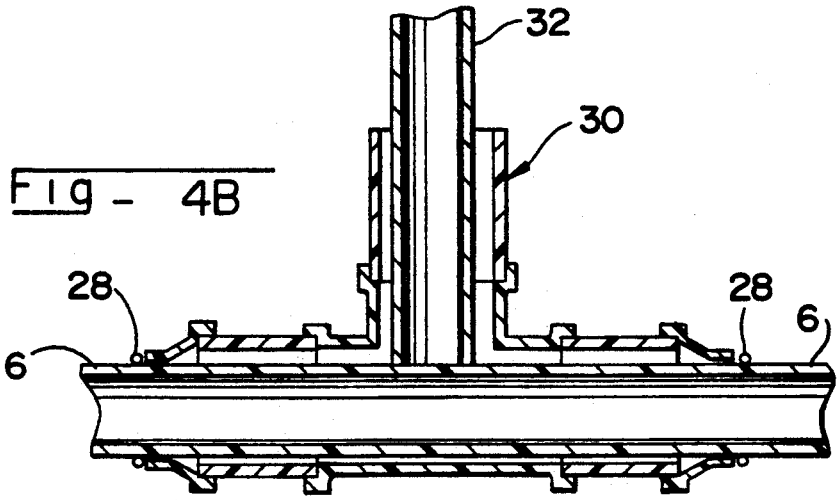
FIG. 4B is a cut away view of the mast base receptacle.
Figure 5A:
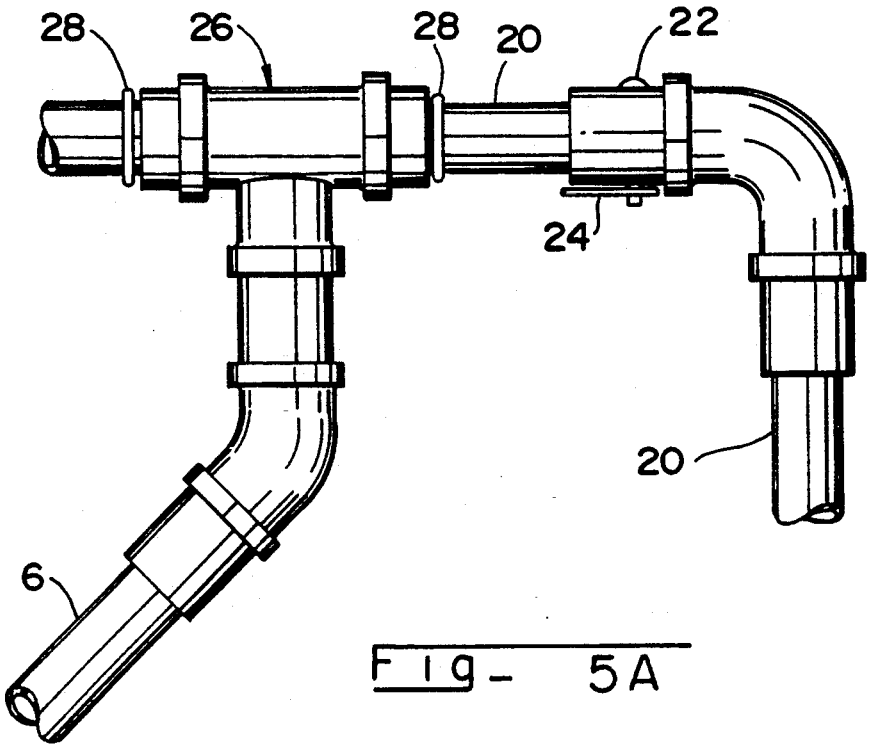
FIG. 5A is a top view of two adjoining base leg sections with one base leg section having a connection for the base diagonal.
Figure 5B:
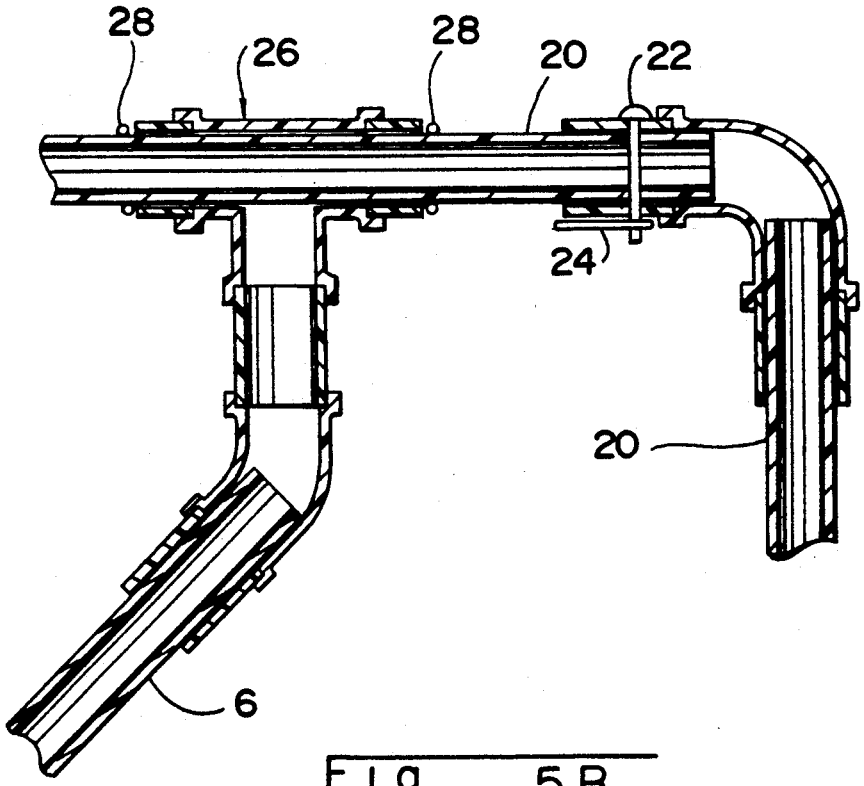
FIG. 5B is a cut away view of two adjoining base leg sections with one base leg section having a connection for the base diagonal.

The bottom end of each pyramid leg 8 is configured to slideably mate with a corresponding base T-fitting 18. Detailed drawings of a base T-fitting 18 are shown in FIGS. 3A and 3B. Each base T-fitting 18 is configured so as to rotate around the longitudinal axis of each base leg 20. Such rotation permits the easy setup and mating of each permanent leg 8 with each base T-fitting 18 under varying ground level conditions.

Although a number of commonly known connections between each pyramid leg 8 and each base T-fitting 18 are possible, it has been found that a slideable connection wherein each pyramid leg 8 firmly slides into each base T-fitting 18 and wherein each pyramid leg 8 is held in such alignment by means of a hitch pin 22 locked into place by a spring clip 24 is both effective and inexpensive. In this configuration, an aperture is formed in one surface of each base T-fitting 18, through each pyramid leg 8 and through the other surface of each base T-fitting 18. During assembly, each pyramid leg 18 is slideably placed in each base T-fitting 18, the respective apertures aligned, the hitch pin 22 placed in each aperture, and is locked in place by means of a spring clip 24. This effectively prevents each pyramid leg 8 from being disengaged from each base T-fitting 18 until each hitch pin 22 is removed.

As shown in FIGS. 3A and 3B, 5A and 5B, each base leg 20 is continuous from one corner to the other corner of base 4. This is to capitalize on the integral strength of each base leg 20. Since each base leg 20 will be ground contacting when in use and it is likely that the ground in most situations will not be planar, the continuity of each base leg 20 will tend to compensate for uneven ground conditions. The net result will be a more uniform support over uneven ground surfaces. Since each base leg 20 is unitary, each base T-fitting 18 and each center diagonal T 26 may be slideably and rotatably disposed along and about each base leg 20. Each base T-fitting 18 and each center diagonal T-fitting 26 are locked longitudinally in place along each base leg 20 by means of clamps 28 placed around each base leg 20 before and after each base T-fitting 18, each center diagonal T 26 and the mast base T-fitting 30. This permits lateral field adjustments of the "Ts", 18, 26 and 30, to compensate for uneven ground conditions. Each base leg 20 may also be locked to the adjoining base leg 20 by means of hitch pin 22 and spring clip 24 as described above.

Figure 8:
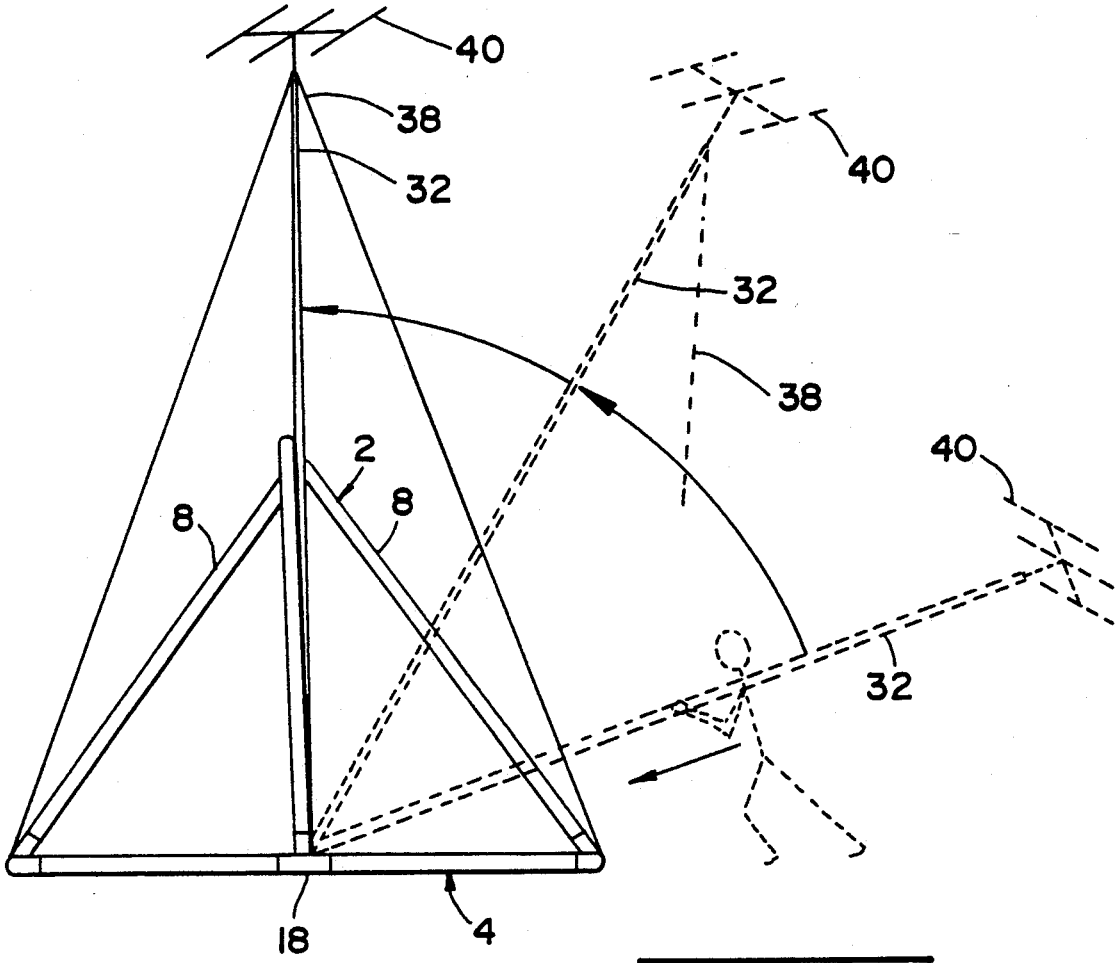
FIG. 8 is a perspective view of a stick figure rotating the mast into a vertical position.

A base diagonal 6 is placed between two opposite base legs 20. The purpose of the base diagonal 6 is to rigidly hold and align the foot or bottom end of mast 32 so as to be in vertical alignment with the crotch between the tops of two corresponding pyramid legs 8. Mast 32 is inserted into the neck of center diagonal T 26, while in a horizontal position on the ground during setup operations. The mast 32, together with the mast base T-fitting 30, is rotated into a vertical position as shown in FIG. 8. The entire system of the mast base T-fitting 30, the center diagonal 6, and the entire base 4 will act together as an aligning footer so that one person may raise the mast 32 unassisted if necessary. Sandbags 34 or other weights may be placed as strategic points on base legs 20 to anchor the base 4 to the ground during assembly and use.

It has been found in operation that it is extremely important to have the mast 32 set in a vertical position to have the mast's 32 center of gravity focused into the center of the mast base T-fitting 30. This is especially critical when the mast support system is set up on uneven ground. The crotch between the tops of two adjacent pyramid legs 8 and the mast locking strap 36, FIG. 6, will accommodate the mast 32 at many angles. To adjust the angle of the mast 32 with respect to the pyramid 2, the mast base T-fitting 30 may be moved laterally along the center diagonal 6 by adjusting clamps 28 on each side of the mast base T-fitting 30. If necessary, the entire center diagonal 6 may be moved in a contra lateral direction with respect to the base legs 20 by adjusting clamps 28 and moving each center diagonal T-fitting 26 along each respective base leg 20. It has been found that being able to adjust the mast base T-fitting 30 and the center diagonal T-fitting 26 will permit the mast 3 to be set up vertically although the ground is uneven.

During setup, when the mast 32 is in the horizontal position, guy wires 38 and any antenna 40 or other item may be connected to the top of mast 32. Any electrical wiring and any antenna maintenance may also be performed when the mast 32 is in the horizontal position. The mast 32 may safely be moved from a vertical to a horizontal position for maintenance of the antenna without disassembling the base or the pyramid.

Once mast 32 is rotated to a vertical position, guy wires 38 may be secured to guy wire cleats 42 on each pyramid leg 8. For additional security, the guy wires 38 may be further attached to tent stakes 42, trees or other items firmly anchored in the ground.

At the end of an event, when the mast 32 is to be brought down, the guy wires 38 are released from guy wire cleats 42. The mast locking strap 36 is then released. The mast 32, with its base still in the neck of center T 26 is rotated from a vertical to a horizontal position about center diagonal 6. Guy wires 38 may be used to control the descent of mast 32. Once mast 32 is in a horizontal position, the antenna and any other electrical work is removed from the mast 32. If the mast 32 is telescopic, it may be collapsed. The pyramid 2 is then disconnected from base 4 by means of withdrawing hitch pin 22 and spring clip 24. Base legs 20 are similarly separated from center diagonal 6 by withdrawing hitch pin 22 and spring clip 24. The entire mast 32 is then laterally aligned and is packed for storage and shipment.

It will be noted that no tools are required for the setup and take-down of this mast 32 and antenna assembly system. It will be obvious from the above that there are numerous slight variations of the above which can be made without departing from the nature and spirit of the invention.

What I claim is:

1. A portable mast support structure comprising:

a plurality of interconnected base legs;

a center diagonal between two opposite said base legs;

a pyramid, comprised of a plurality of pyramid legs interconnected at the top ends thereof;

means for connecting the bottom end of each of said pyramid legs to each of said base legs;

a mast;

means for maintaining said mast in a vertical orientation against said pyramid;

means, connected to said center diagonal, for receiving the bottom end of said mast; and, means for adjusting the position of said means for receiving the bottom end of said mast both laterally and and contra laterally with respect to said pyramid.

2. A portable mast support structure as recited in claim 1, wherein said means for receiving the bottom end of said mast further comprises a center diagonal T-fitting.

3. A portable mast support structure as recited in claim 2, wherein said center diagonal T-fitting is laterally adjustable along the axis of said center diagonal.

4. A portable mast support structure as recited in claim 3, wherein said center diagonal T-fitting is adapted to rotate about said center diagonal.

5. A portable mast support structure as recited in claim 3, further comprising clamps to limit the lateral movement of said center T-fitting along the axis of said center diagonal.

6. A portable mast support structure as recited in claim 1, wherein each of said pyramid legs mates with a fitting disposed on each of said base legs.

7. A portable mast support structure as recited in claim 6, wherein each of said pyramid legs is secured in position by means of hitch pins.

8. A portable mast support structure as recited in claim 6, wherein said fitting is a T-fitting.

9. A portable mast support structure as recited in claim 8, further comprising clamps to limit the lateral movement of said T-fittings along each of said base legs.

10. A portable mast support structure as recited in claim 1, wherein each of said base legs interconnect with one another.

11. A portable mast support structure as recited in claim 10, wherein each of said base legs are locked into position by means of hitch pins.

12. A portable mast support structure as recited in claim 1, wherein said means for maintaining a mast in a vertical orientation against said pyramid further comprises a mast locking strap adjustably disposed between two adjacent said pyramid legs.

13. A portable mast support structure as recited in claim 1, wherein each of said pyramid legs are rigidly locked in an extended position when each of said pyramid legs are connected to each of said base legs.

14. A portable mast support structure as recited in claim 1, wherein each of said pyramid legs are hinged to permit easy storage and transportation.

15. A portable mast support structure as recited in claim 1, further comprising weights placed on at least one of said base legs to stabilize the mast support system.

16. A portable mast support structure as recited in claim 15, wherein said weights are sandbags.

17. A portable mast support structure as recited in claim 1, wherein guy wires are used to stabilize said mast after said mast is rotated into a vertical position.

18. A portable mast support structure as recited in claim 17, further comprising cleats disposed on each of said pyramid legs for anchoring said guy wires to each of said pyramid legs.

19. A portable mast support structure as recited in claim 18, further comprising tent pegs disposed in the ground adjacent to each of said base legs wherein said guy wires are attached between said cleats and said tent pegs.

20. A portable mast support structure as recited in claim 1, further comprising inter-pyramid leg wires for support.

* * * * *